US010228206B2

(12) United States Patent
Bordley et al.

(10) Patent No.: US 10,228,206 B2
(45) Date of Patent: Mar. 12, 2019

(54) HANDGUN SAFETY DEVICE

(71) Applicants: Robert Gerard Bordley, Torrance, CA (US); Eric Ratley, Rancho Palos Verdes, CA (US)

(72) Inventors: Robert Gerard Bordley, Torrance, CA (US); Eric Ratley, Rancho Palos Verdes, CA (US)

( * ) Notice: Subject to any disclaimer, the term of this patent is extended or adjusted under 35 U.S.C. 154(b) by 0 days.

(21) Appl. No.: 15/730,510

(22) Filed: Oct. 11, 2017

(65) Prior Publication Data

US 2018/0100715 A1 Apr. 12, 2018

Related U.S. Application Data

(60) Provisional application No. 62/406,819, filed on Oct. 11, 2016.

(51) Int. Cl.
*F41A 17/54* (2006.01)

(52) U.S. Cl.
CPC ..... *F41A 17/54* (2013.01)

(58) Field of Classification Search
CPC ..... F41A 17/00; F41A 17/02; F41A 17/06; F41A 17/46; F41A 17/52; F41A 17/54
USPC ..... 42/70.01, 70.06, 70.07, 70.11
See application file for complete search history.

(56) References Cited

U.S. PATENT DOCUMENTS 1,686,482 A 10/1928 Windle
1,887,308 A * 11/1932 Jessup ..... F41A 17/54 42/70.06
2,080,202 A 5/1937 Drake
2,590,516 A 3/1952 De Von Breymann
2,709,865 A * 6/1955 Bohenek ..... F41A 17/54 42/70.06
3,064,383 A 11/1962 Newson, Sr.
3,269,046 A * 8/1966 Schaefer ..... F41A 17/54 42/70.06
4,030,221 A * 6/1977 Doobenen ..... F41A 17/54 42/70.07
4,422,254 A * 12/1983 McQueen ..... F41A 17/56 42/70.05
4,509,281 A * 4/1985 Dreiling ..... F41A 17/54 42/70.07
5,012,605 A * 5/1991 Nishioka ..... F41A 17/54 42/70.07

(Continued)

*Primary Examiner* — John Cooper
(74) *Attorney, Agent, or Firm* — Knobbe Martens Olson & Bear, LLP

(57) ABSTRACT

Methods and apparatuses are disclosed for increasing the safety of a handgun. In certain implementations, the apparatus provides a safety device that includes a cover having an ejecting unit, a locking pin, and a releasing plate. The safety device is configured to cover both sides of a trigger guard of the handgun when the safety device is locked to the handgun. The releasing plate is coupled to the locking pin. The releasing plate is disposed on a surface of the safety device so as to be accessible by the user. Preferably, the releasing plate is activated by a user's finger. The releasing plate selectively disengages the locking pin from the trigger guard by movement of the user's finger. When engaged, the locking pin prevents the safety device from being removed from the handgun. When disengaged, the locking pin allows the safety device from being removed from the handgun. In certain embodiments, the ejection unit self-ejects the safety device from the handgun.

16 Claims, 12 Drawing Sheets

(56) References Cited

U.S. PATENT DOCUMENTS

| | | | | |
|---|---|---|---|---|
| 5,075,994 | A | 12/1991 | Nishioka | |
| 5,611,164 | A * | 3/1997 | Rassias | F41A 17/44 42/70.11 |
| 5,778,586 | A * | 7/1998 | Carlson | F41A 17/54 42/70.07 |
| 6,205,695 | B1 * | 3/2001 | Schnell | F41A 17/54 42/70.07 |
| 6,438,885 | B1 * | 8/2002 | Murray | F41A 17/54 211/64 |
| D462,735 | S | 9/2002 | Rohde et al. | |
| 6,487,803 | B1 | 12/2002 | Yu | |
| 6,550,175 | B2 * | 4/2003 | Parker | F41A 17/04 42/70.07 |
| D485,595 | S | 1/2004 | Schaub | |
| 7,216,449 | B2 | 5/2007 | Riebling et al. | |
| 7,367,150 | B2 | 5/2008 | Farchione et al. | |
| 8,186,087 | B2 | 5/2012 | Ogershok | |
| D670,351 | S | 11/2012 | Skaggs, Sr. | |
| 9,322,605 | B1 * | 4/2016 | Noyons | F41A 17/54 |
| 2005/0224537 | A1 * | 10/2005 | Rassias | F41A 17/02 224/243 |
| 2014/0027479 | A1 * | 1/2014 | Hogue | F41C 33/0218 224/183 |
| 2017/0023324 | A1 * | 1/2017 | Xu | F41A 17/54 |
| 2017/0146314 | A1 * | 5/2017 | Nelson | F41C 9/02 |
| 2017/0205186 | A1 * | 7/2017 | Kjellberg | F41C 9/02 |

* cited by examiner

HANDGUN SAFETY DEVICE

CROSS-REFERENCE TO RELATED APPLICATIONS

This application claims priority to U.S. Provisional Application No. 62/406,819, entitled "HANDGUN SAFETY DEVICE," filed on Oct. 11, 2016, which is hereby incorporated by reference herein in its entirety.

BACKGROUND

Field of the Invention

Certain aspects of the present disclosure generally relate to firearms, and more particularly, to methods and apparatuses that decrease the chance occurrence of an unintended discharge of a concealed firearm such as a handgun.

Description of the Related Art

Many handguns do not have a traditional manually operated on-off safety or lack one entirely as part of their design. This results in a user potentially being able to activate the trigger and fire the handgun. When the handgun is in a pocket or purse, foreign objects, such as keys, can become entwined with a trigger of the handgun. In such a situation, just the action of pulling the handgun or keys out of the pocket can accidently activate the trigger.

A user who wants to gain access to their handgun in an emergency from a pocket can easily grab the handgun while inadvertently slipping their trigger finger into the trigger guard. As the user begins removing the handgun from their pocket, their finger can accidentally pull the trigger causing an accidental discharge.

In addition to the risk of an unintended discharge of a concealed firearm, there is also a risk that the firearm will not be ready to be fired once removed from the pocket. Advantageously, certain embodiments protect a person who has a handgun in their pocket or purse etc. In many designs the handgun may only fire when the magazine is seated in the grip. A user who is in need of their handgun to protect them self quickly may not have enough time to contemplate the appropriate steps to take when removing their handgun from their pocket. Instead, the user may pull out their handgun only to find it is not operable and at that moment they could have created a life or death situation for them self.

As such, systems and methods are needed to solve these common problems and others.

SUMMARY

Details of one or more implementations of the subject matter described in this specification are set forth in the accompanying drawings, pictures, and the description below. Other features, aspects, and advantages will become apparent from the description, the drawings, and the claims. Note that the relative dimensions of the following figures may not be drawn to scale.

According to certain embodiments, a safety device for a trigger guard of a handgun can include a cover, a locking member, a releasing member, and an ejecting unit. The cover can be sized and shaped to cover at least a portion of the trigger guard. The locking member can be disposed so as to move between an engaged position and a disengaged position. The releasing member can be coupled to the locking member so that activation of the releasing member moves the locking member from the engaged position to the disengaged position. The ejecting unit can be coupled to the cover. The ejecting unit can contact at least a portion of the handgun. The ejecting unit can bias the cover to eject the safety device from the handgun when the locking member is moved to the disengaged position.

According to certain embodiments, a safety device for a trigger guard of a handgun can include a cover. The cover can include a locking pin, a releasing plate, and an ejecting unit. The locking pin can be disposed so as to move between an engaged position and a disengaged position with the trigger guard. The releasing plate can be coupled to the locking pin so that activation of the releasing plate moves the locking pin from the engaged position to the disengaged position. The ejecting unit can be disposed in the cover. The ejecting unit can contact the trigger guard. The ejecting unit can bias the cover to eject the safety device from the handgun when the locking pin is disengaged with the trigger guard.

According to certain embodiments, a safety device for a trigger guard of a handgun can include a cover and a releasing member. The cover can be sized and shaped to cover at least a portion of the trigger guard. The cover can include a locking member. The locking member can be disposed so as to move between an engaged position and a disengaged position. The releasing member can be coupled to the locking member so that activation of the releasing member moves the locking member from the engaged position to the disengaged position to allow separation of the safety device from the handgun.

DETAILED DESCRIPTION

Figure 2:
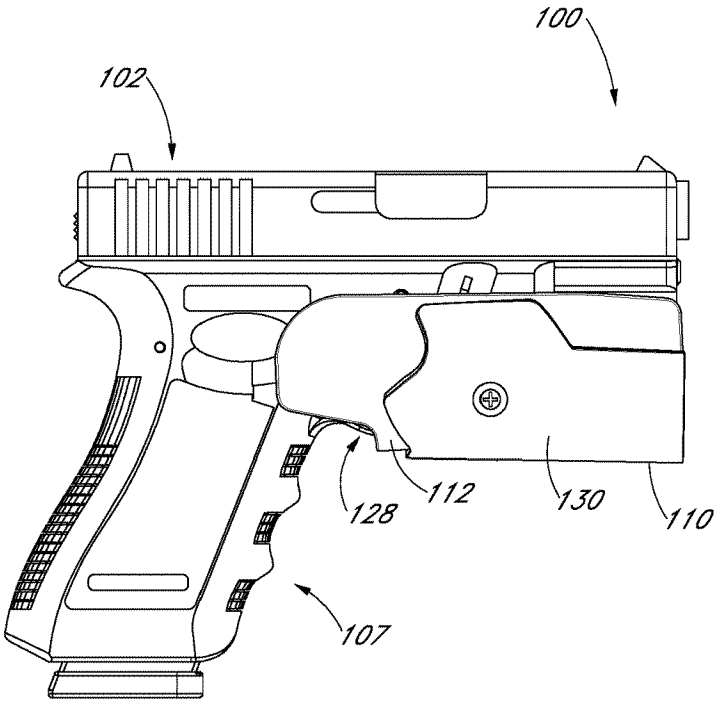
FIG. 2 illustrates a second side view of the safety device of FIG. 1 positioned on a handgun.
Figure 1:
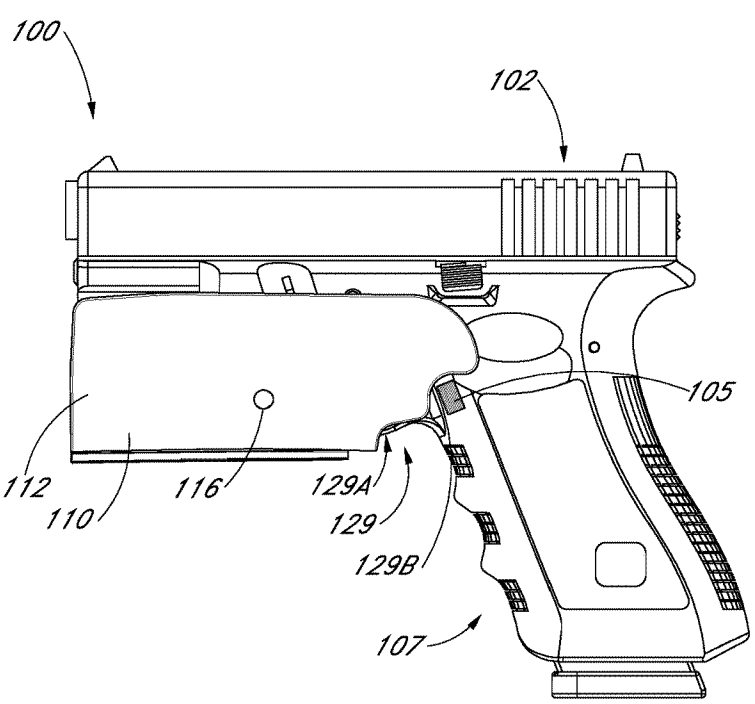
FIG. 1 illustrates a first side view of an exemplary embodiment of a safety device positioned on a handgun in which aspects of the present disclosure can be employed.
Figure 4:
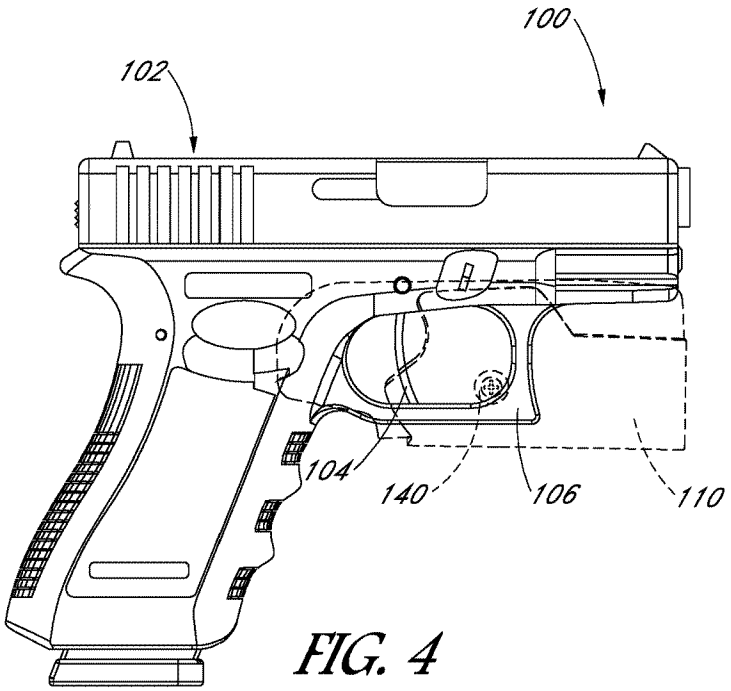
FIG. 4 illustrates the second side view of the safety device of FIG. 1 in dashed lines positioned on the handgun.
Figure 3:
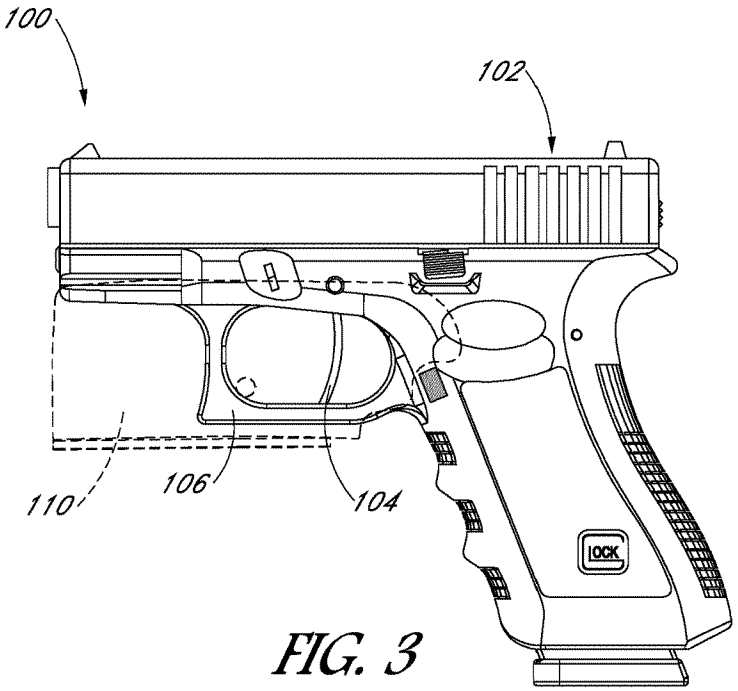
FIG. 3 illustrates the first side view of the safety device of FIG. 1 in dashed lines positioned on the handgun.

Various aspects of the novel systems, apparatuses, and methods are described more fully hereinafter with reference to the accompanying drawings. The teachings of this disclosure can, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of or combined with any other aspect of the invention. For example, an apparatus can be implemented or a method can be practiced using any number of the aspects set forth herein. In addition, the scope of the invention is intended to cover such an apparatus or method which is practiced using other structure, functionality, or structure and functionality in addition to or other than the various aspects of the invention set forth herein. It should be understood that any aspect disclosed herein can be embodied by one or more elements of a claim.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. The detailed description and drawings are merely illustrative of the disclosure rather than limiting, the scope of the disclosure being defined by the appended claims and equivalents thereof.

Methods and apparatuses are disclosed for increasing the safety of a handgun. As discussed below, certain embodiments of the safety device slide over the trigger guard assembly, lock into place, and completely cover the trigger guard assembly.

As shown in at least FIGS. 1-17, a safety device assembly 100 can include a gun 102 and a safety device 110. The safety device 110 can include a cover 112. The cover 112 can include a releasing plate or releasing member 130 and a locking pin or locking member 140. In certain embodiments, the safety device 110 includes an ejecting unit 150.

In certain embodiments, the safety device 110 is not a holster but is a safety mechanism intended to prevent unintentional discharge of the firearm. In certain embodiments, the safety device 110 is intended for use in a pocket, purse, bag, etcetera, and not attached to the waist. In certain embodiments, the safety device 110 is intended to self-eject from the handgun in contrast to a holster which just allows for the gun 102 to be drawn.

In certain embodiments, the safety device 110 covers and prevents the magazine release button from being pressed to avoid unseating the magazine in the grip. In certain embodiments, the safety device 110 has a low profile to facilitate use with a concealed gun 102 and follows the contours of the gun 102.

In certain embodiments, the safety device 110 includes structures or features which prevent or inhibit the safety device 110 from easily exiting a pocket thereby facilitating the user removing the gun 102 from the safety device 110 when the user unlocks the safety device 110 from the gun 102 in the pocket. In this way, the features of the safety device 110 make it easier for the user to remove the gun 102 without the safety device 110 coming out of the pocket with the gun 102. For example, a releasing plate component of the safety device 110 can include one or more shapes or surface features which inhibit removal of the safety device 110 from a user's pockets.

The cover 112 can define a generally U-shaped channel. In some configurations, the cover 112 can define a channel having other shapes, such as a rectangular channel or squared channel. The channel can be configured to receive at least a portion of the trigger guard 106 of the gun 102. In certain embodiments, the cover can include a bottom wall 124 having a width. The trigger guard 106 can have a width. The width of the bottom wall 124 can be approximately equal to the width of the trigger guard 106. In certain embodiments, the width of the bottom wall 124 is greater than the width of the trigger guard 106. The safety device 110 can desirably have a low profile so that the assembly 100 can be easily carried in the user's pocket, bag, holster, or other compartment.

Figure 15:
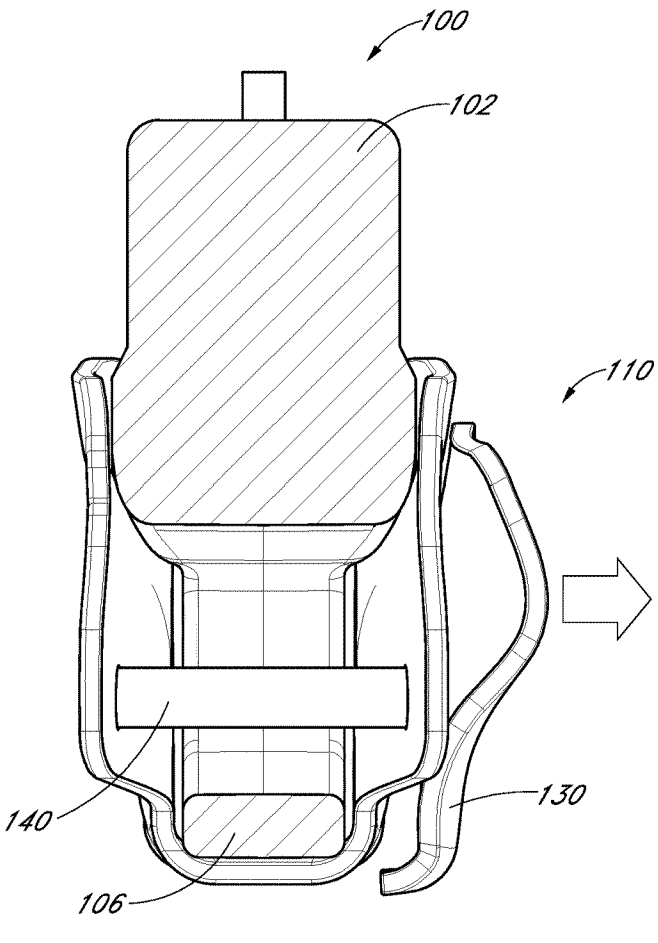
FIG. 15 illustrates a rear cross-sectional view of the safety device of FIG. 1 positioned on a handgun in an engaged position, taken along line 15-15 of FIG. 17.

In certain embodiments, the safety device 110 can cover at least a portion or all of one or both sides of the trigger guard 106 when the safety device 110 is in an engaged position relative to the gun 102 (see FIG. 15).

The cover 112 can include a front wall 118, a first side wall 120, a second side wall 122, and a bottom wall 124. The front wall 118, the first and second side walls 120, 122, and the bottom wall 124 of the cover 112 can be integrally formed.

In certain embodiments, one or more of the first side wall 120 and the second side wall 122 can be configured to be coupled to the releasing plate 130. In certain embodiments, the second side wall 122 is configured to be coupled to the releasing plate 130. In certain embodiments, the second side wall 122 can be coupled to the releasing plate 130 at one or more positions. In certain embodiments, the second side wall 122 can be coupled to the releasing plate 130 at two, three, or four or more positions. As shown in at least FIG. 10, in certain embodiments, the second side wall 122 can include a cover hinge portion 126. The cover hinge portion 126 is configured to mate with a corresponding releasing plate hinge portion 136 positioned at an end of the releasing plate 140. In certain configurations, the hinge portions 126, 136 have a plurality of protrusions and recesses. The corresponding protrusions and recesses of the cover hinge portion 126 and the releasing plate hinge portion 136 can interlock to define a hinge. In certain configurations, other hinge structures are contemplated. The hinge can allow the releasing plate 140 to rotate away from the cover 112, for example, to disengage the safety device 110 from the gun 102 in use. In certain embodiments, the hinge can define an axis of rotation about which the releasing plate 140 can rotate relative to the cover 112.

In certain embodiments, the second side wall 122 of the cover 112 can include an insertion hole 114. The insertion hole 114 can be configured to receive the locking pin 140. The insertion hole 114 can be sized and/or shaped to allow the locking pin 140 to slide through the hole. In some embodiments, the insertion hole 114 allows the locking pin 140 to slide through with minimal resistance to desirably reduce wear on the locking pin 140 and/or allow for a faster engagement and/or disengagement of the safety device 110 from the gun 102.

Figure 6:
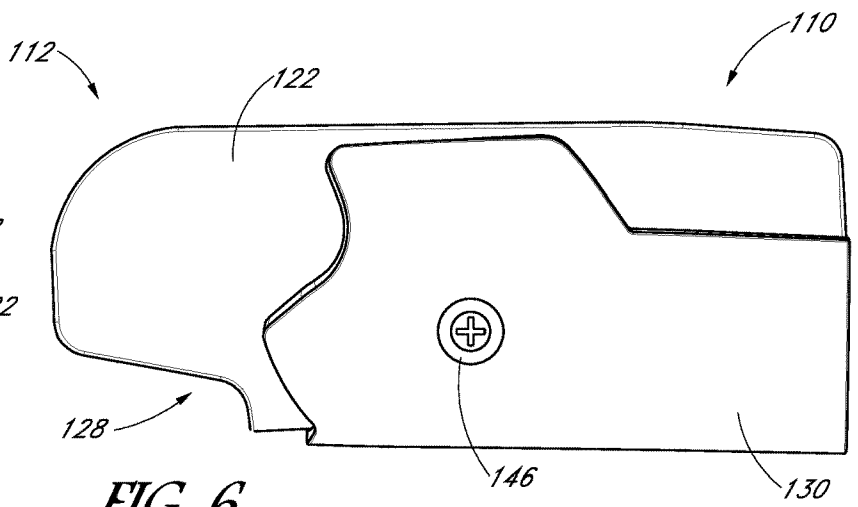
FIG. 6 illustrates a second side view of the safety device of FIG. 1.
Figure 7:
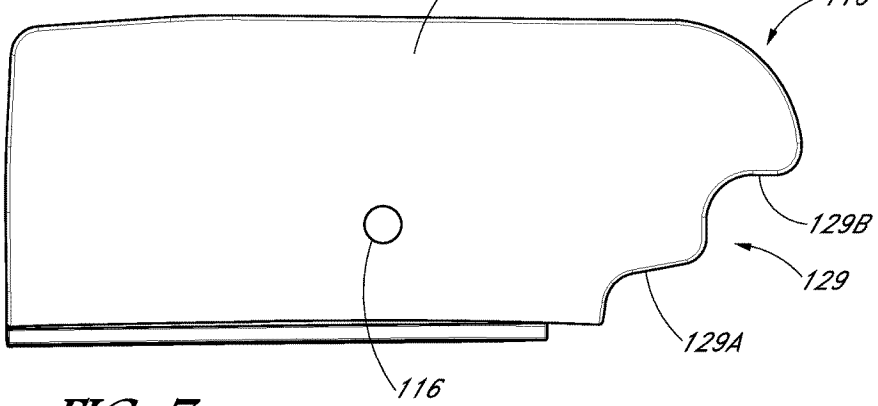
FIG. 7 illustrates a first side view of the safety device of FIG. 1.
Figure 5:
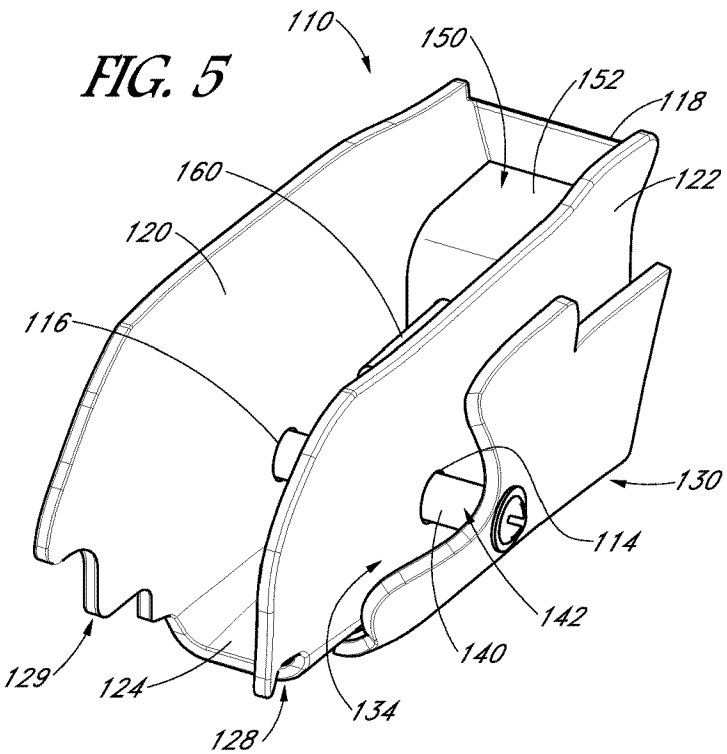
FIG. 5 illustrates a front, top, and second side perspective view of the safety device of FIG. 1.
Figure 10:
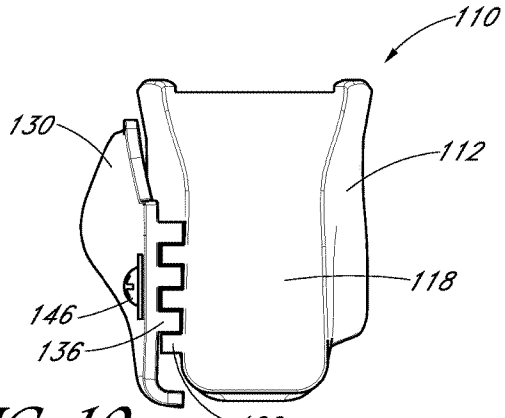
FIG. 10 illustrates a front view of the safety device of FIG. 1.
Figure 11:
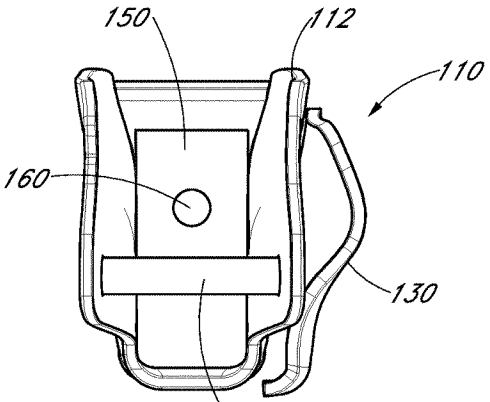
FIG. 11 illustrates a rear view of the safety device of FIG. 1.
Figure 8:
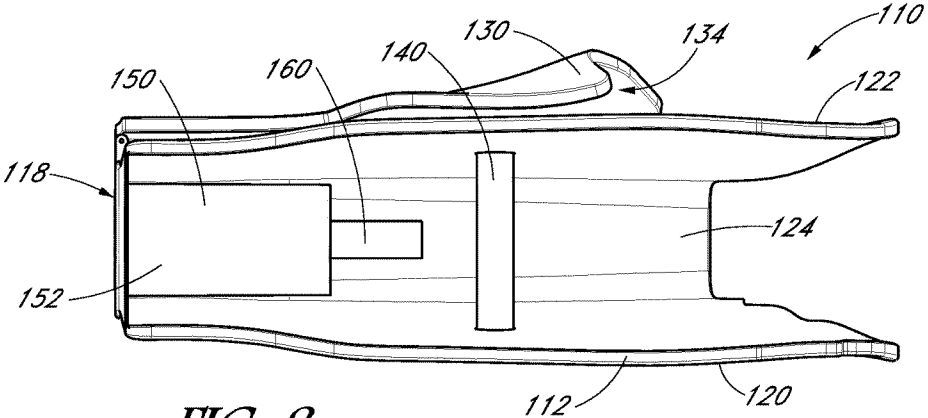
FIG. 8 illustrates a top view of the safety device of FIG. 1.
Figure 9:
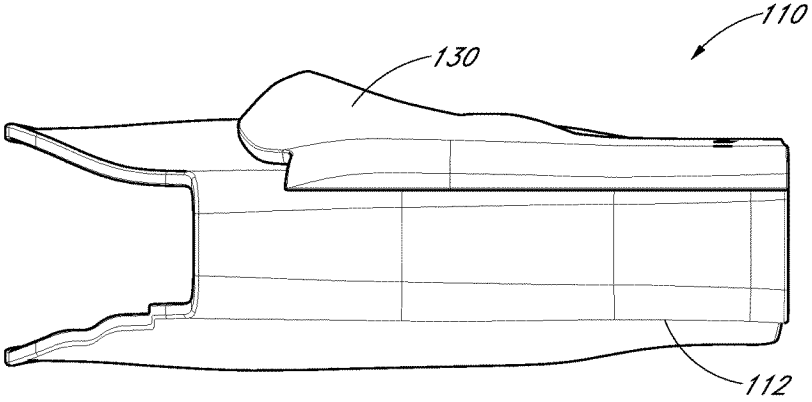
FIG. 9 illustrates a bottom view of the safety device of FIG. 1.

The insertion hole 114 can be positioned at an approximately midpoint of the side wall 122 along a length of the wall 122 (see FIG. 6). In certain embodiments, the insertion hole 114 is positioned forward or rearward of the midpoint of the wall 122 along the length of the wall 122. In certain embodiments, the positioning of the insertion hole 114 corresponds to a position of the trigger guard and/or the trigger of the gun 102 on which the safety device 110 is configured to be coupled. In certain embodiments, the insertion hole 114 is positioned to allow the locking pin 140 to pass through and be positioned adjacent a front interior surface of a front wall of the trigger guard 106 in the engaged position and/or in front of the trigger without contacting the trigger. In certain embodiments, the insertion hole 114 is positioned rearward of the front wall of the trigger guard 140. In certain embodiments, the insertion hole 114 is positioned on a lower half of the side wall 122, at a vertical midpoint of the side wall 122 and/or on an upper half of the side wall 122. The positioning of the insertion hole 114 can allow the locking pin 140 to be positioned adjacent to and/or contact at least a portion of an interior surface of the trigger guard 106, such as a front interior surface and/or a bottom interior surface.

In certain embodiments, the side wall 122 can include a cutout portion 128 at a rearward portion of the side wall 122. The cutout portion 128 can allow the cover 112 to have a reduced profile. The reduced profile can desirably reduce material and/or the overall bulkiness of the safety device 110. In certain configurations, the size and/or shape of the cutout portion 128 can correspond to a shape of at least a portion of the gun 102. For example, the cutout portion 128 can provide a user with full access to a grip portion 107 of the gun 102. In such configurations, the cutout portion 128 allows the user to fully grasp the gun 102 when the safety device 110 is positioned on the gun 102.

In certain embodiments, the first side wall 120 can have a cutout portion 129 at a rearward portion of the side wall 120. The cutout portion 129 can define a scalloped region. In certain embodiments, the cutout portion 129 can include a plurality of cutout portions, such as one, two, three, four, or five or more cutout portions. The cutout portions 129 can provide access to certain features of the gun 102. For example, the cutout portion 129 can include a first cutout portion 129A and a second cutout portion 129B. In certain embodiments, at least the first cutout portion 129A can provide a user with full access to a grip portion of the gun 102. In such configurations, the cutout portion 129A allows the user to fully grasp the gun 102 when the safety device 110 is positioned on the gun 102. In certain configurations, the cutout portion 129B can provide access to at least another portion of the gun 102, such as a magazine lock 105. Such configurations can be desirable to allow the user to load and/or reload the gun 102 while the safety device 110 is positioned on (e.g., fully on) the gun 102.

As shown, the first side wall 120 can include a mating hole 116 in certain embodiments. The mating hole 116 can be positioned in axial alignment with the insertion hole 114. The mating hole 116 can be positioned in a similar position to the insertion hole 114 along the first side wall 120.

In certain embodiments, the mating hole 116 forms a through-hole such that the hole 116 extends entirely through the side wall 120. In certain embodiments, the mating hole 116 defines a recess along an interior surface of the side wall 120. The mating hole 116 can be configured to receive at least a portion of the locking pin 140, such as a mating end portion 144 of the locking pin 140. The mating end portion 144 of the locking pin 140 can pass through all or a portion of the mating hole 116 in the engaged position. In certain embodiments, contact between an interior surface of the mating hole 116 and an exterior surface of the mating end portion 144 of the locking pin 140 can create sufficient force to secure the safety device 110 on the gun 102 and/or resist the biasing force caused by the ejecting unit 150 (e.g., the biasing member and/or the ejecting member) on the trigger guard 106. In certain embodiments, the locking pin 140 is configured to pass through or sit partially within the mating hole 116. In certain embodiments, the mating end portion 144 can engage the mating hole 116 via a press-fit configuration. In certain embodiments, the mating end portion 116 has a groove, such as a circumferential groove or other mating feature that is configured to sit within or engage the mating hole 116 to secure the locking pin 140 in the engaged position.

In certain embodiments, the first side wall 120 does not include the mating hole 116. In such embodiments that do not include the mating hole 116, the locking pin 140 need not include the mating end portion 144. In such embodiments, the locking pin 140 has a sufficient length to secure the safety device 110 on the gun 102 and/or resist the biasing force caused by the ejecting unit 150 (e.g., the biasing member and/or the ejecting member) on the trigger guard 106 without the locking pin 140 securing to the first side wall 120.

For example, in certain embodiments, a length of the locking pin 140 allows a distal portion of the locking pin 140 to be positioned within the trigger guard 106 with the distal portion also being spaced from the first side wall 120. In such embodiments, a gap may be formed between the distal portion of the locking pin 140 and the first side wall 120. When the locking pin 140 is disposed within the trigger guard 140, the locking pin 140 desirably prevents the safety device 110 from being removed from the handgun 102. This can also prevent access to the trigger 104 and/or help to inhibit or limit accidental actuation of the trigger 104.

In certain embodiments, the distal portion of the locking pin 140 contacts the first side wall 120 without securing to the first side wall 120.

The locking pin 140 can include a second end 142. The second end 142 can be integral with or coupled to the releasing plate 130 by various connection mechanisms. For example, in certain embodiments, the locking pin 140 and the releasing plate 130 are manufactured as a unitary structure. For example, in certain embodiments, the locking pin 140 can be coupled to the releasing plate 130 by a mechanical fastener 146, such as a screw or bolt, an adhesive, and/or a threaded connection, among other fastening features.

As shown in at least FIGS. 5-11, the releasing plate 130 can be coupled to the locking pin 140. In certain embodiments, the releasing plate 130 is disposed on a surface of the safety device 110 so as to be accessible by the user. For example, as discussed above, the releasing plate 130 can be coupled to the second side wall 122 of the cover 120 via the locking pin 140 and/or the hinge formed by the hinge portions 126, 136.

The releasing plate 130 can have a shape that generally corresponds to a shape of the side wall 122. In certain embodiments, at least a front side and/or a bottom side of the releasing plate 130 corresponds to the shape of the corresponding features of the side wall 122. In certain embodiments, the releasing plate 130 can include a rearward portion. The rearward portion of the releasing plate 130 can define an access region that is accessible to the user. For example, the access region of the releasing plate 130 can be angled outwardly relative to the outer surface of the side wall of the releasing plate 130 and/or the cover 112 when assembled. In certain embodiments, the angled access region of the releasing plate 130 and the side wall 122 of the cover 112 defines an interior space 134 that can be accessed by the user. As explained in more detail below, the releasing plate 130 can be activated by a user's finger sliding into at least a portion of the interior space 134 between the releasing plate 130 and the cover 112.

As discussed above, the cover 112 can include the ejecting unit 150. The ejecting unit 150 can be positioned within at least a portion of the channel of the cover 112. In certain embodiments, the ejecting unit 150 can be positioned in a forward portion of the cover 112, such as against the front wall 118 of the cover 112. In certain embodiments, the ejecting unit 150 is held in place within the cover 112, such as against the front wall 118, the side walls 120, 122, and/or the bottom wall 124. For example, the ejecting unit 150 can be adhered to the cover 112. In certain embodiments, the ejecting unit 150 can be mechanically fastened to the cover 112, such as by a screw or bolt, press-fit into the channel of the cover, and/or integrally formed with the cover 112, among other means.

Figure 12:
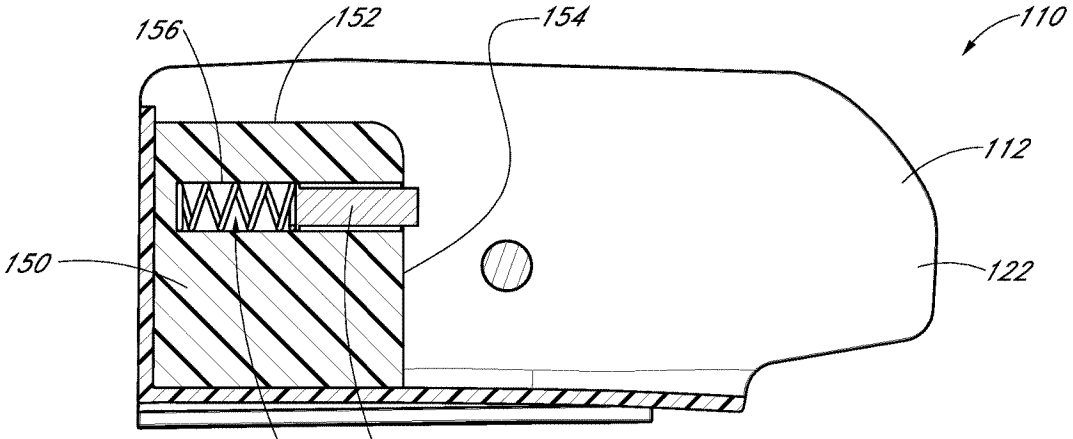
FIG. 12 illustrates a first side cross-sectional view of the safety device of FIG. 1 illustrating certain internal components of the safety device including a cover having an ejecting unit.

FIG. 12 illustrates a side cross-sectional view of the safety device of illustrating the ejecting unit 150 positioned within the cover 112. As shown, the ejecting unit 150 can have a height that is less than a height of the front wall 118 of the cover 112. In certain configurations, the ejecting unit 150 has a height that is approximately equal to the height of the front wall 118 of the cover 112. The ejecting unit 150 can have a top wall 152. The top wall 152 can provide a surface to receive at least a portion of the gun 102 to allow at least a portion of the gun 102 to rest on the ejecting unit 150.

In certain configurations, when the ejecting unit 150 is secured within the cover 112, the ejecting unit extends rearwardly a distance that is less than approximately ½ a length of the cover 112. For example, the ejecting unit 150 can be positioned at least partially or entirely within a forward portion of the cover 112. In certain configurations, the ejecting unit 150 is positioned entirely forward of holes 114, 116 and/or the locking pin 140 when the safety device 110 is in the engaged position.

Figure 14:
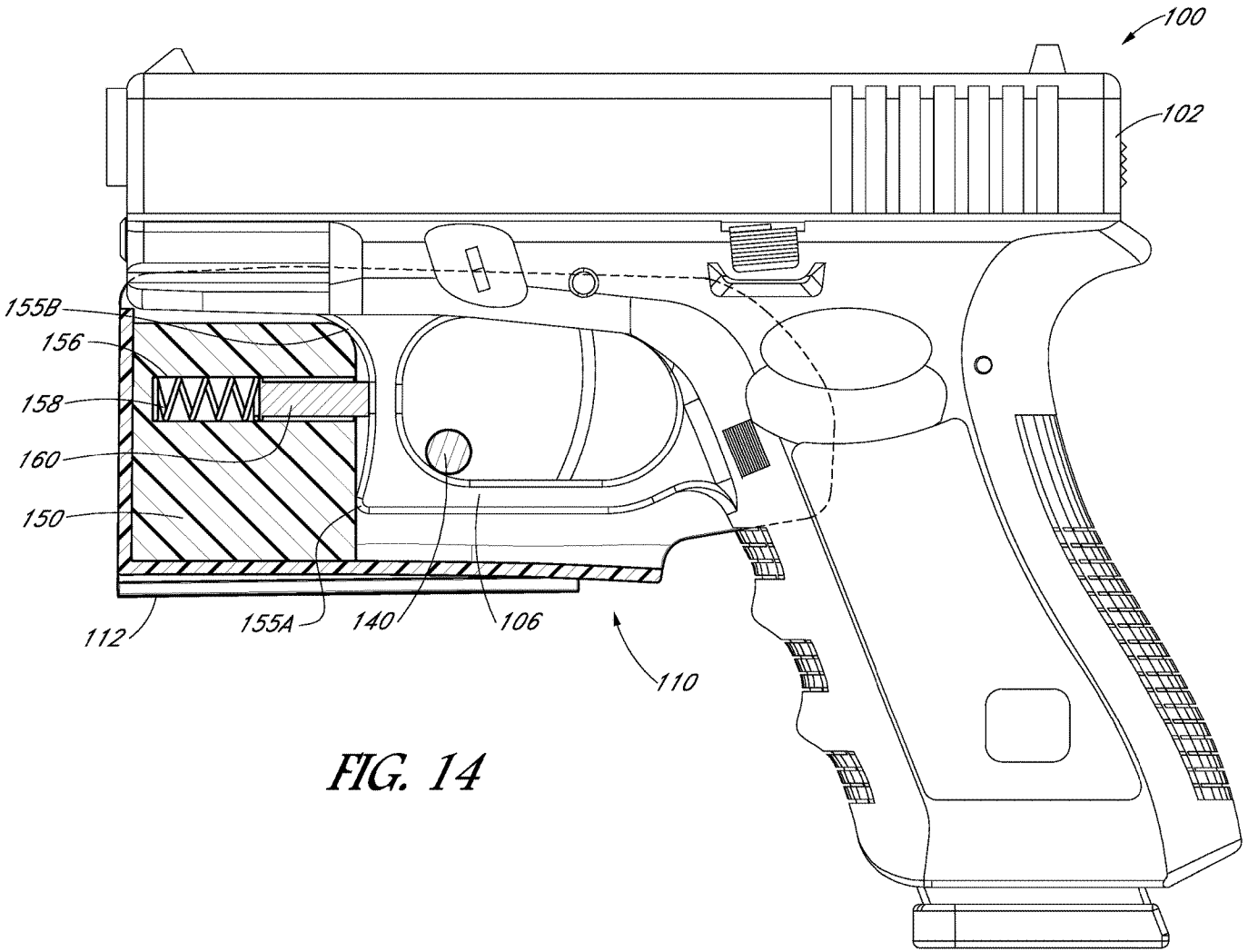
FIG. 14 illustrates a first side cross-sectional view of the safety device of FIG. 1 positioned on a handgun showing an example location of certain internal components of the safety device, including a cover having an ejecting unit and a locking pin, relative to certain portions of the handgun including a trigger guard, taken along line 14-14 of FIG. 17.

As shown in at least FIG. 14, the ejecting unit 150 can be positioned at least partially forward of a front surface of the trigger guard 106. In certain configurations, a shape of a rear wall of the ejecting unit 150 can correspond to a shape of the front surface of the trigger guard 106. For example, in certain configurations, the rear surface of the ejecting unit 150 contacts an entire front surface of the trigger guard 106. In certain configurations, such as the embodiment shown in FIG. 14, the ejecting unit 150 may not contact an entire front surface of the trigger guard 106. In some embodiments, the ejecting unit 150 can have a rounded corner 153. The rounded corner can correspond and/or contact at least a portion of the trigger guard 106. The ejecting unit 150 can contact the trigger guard 106 at at least one or two or more contact points 155A, 155B. The ejecting unit 150 can contact the trigger guard 106 at the contact points when the safety device is in the engaged position and the safety device 112 is secured to the gun 102. In certain configurations, various ejecting units 150 can be used for different types of guns 102 to match the shape of the ejecting unit 150 with the shape of the gun 102. In certain configurations, the ejecting unit 150 can be universally used with a variety of gun types.

Figure 13:
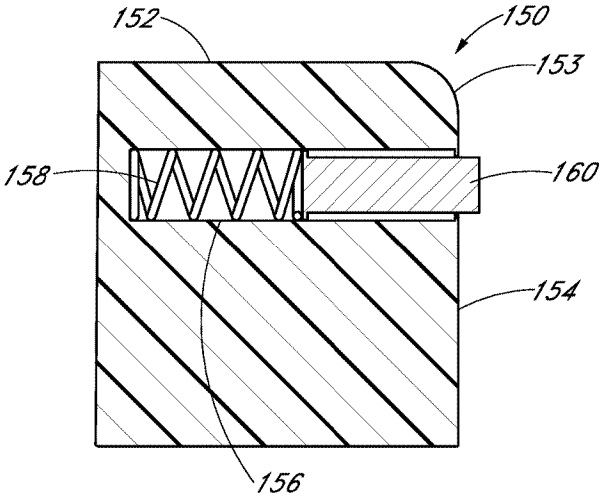
FIG. 13 illustrates a first side cross-sectional view of an embodiment of an ejecting unit of the safety device of FIG. 1.

As shown in at least FIGS. 12-14, the ejecting unit 150 can include a recess 156, a biasing member 158, such as a spring, and an ejecting member 160, among other components. The recess 156 can be formed in the rear wall 154 of the ejecting unit 150. The recess 156 can extend laterally into the ejecting unit 150 toward the front wall of the ejecting unit 150. In certain configurations, the recess 156 extends across a substantial portion of the ejecting unit 150, such that the recess 156 terminates at a position adjacent to and/or near the front wall of the cover 112.

In certain embodiments, the recess 156 can receive the biasing member 158 and/or the ejecting member 160. As shown in at least FIGS. 12-14, the biasing member 158 can be positioned within at least a portion of a forward region of the recess 156 and the ejecting member 160 can be positioned within at least a portion of a rearward region of the recess 156 adjacent the biasing member 158. The ejecting member 160 can be positioned at least partially within the recess 156 when the safety device 110 is in the engaged and/or the disengaged position. In certain embodiments, the ejecting unit 150 includes one, two, three, four or more ejecting members 160.

In certain embodiments, when the safety device 110 is in the engaged position, the ejecting member 160 is configured to contact the front surface of the trigger guard 106. In the engaged position, the biasing member 158 is configured to bias the ejecting member 160 away from the front wall 188 and/or into the trigger guard 106. As discussed in more detail below, the biasing member 158 can bias the safety device 110 to slide off and/or separate from the gun 102 when the safety device 110 moves from the engaged position to the disengaged position (e.g., when the locking pin 140 disengages from the trigger guard 106). The biasing member 158 and/or the ejecting member 160 can cause the ejecting unit 150 to self-eject the safety device 110 from the gun 102 in use. In certain embodiments, the ejecting unit 150 can include one or more air vents. The air vents can help to prevent or limit the ejecting member 160 from creating a vacuum and/or slow release of the safety device 110 from the gun 102.

In certain embodiments, the assembly 100 can be used underwater. In certain embodiments, when the safety device 110 is activated underwater, water may enter the safety device 110. In certain embodiments, to drain the ejecting unit 150, the safety device 110 may be flipped 180 degrees. The ejecting member 160 can be pressed into the biasing member 158 one or more times to expel water from the recess 156.

Figure 17:
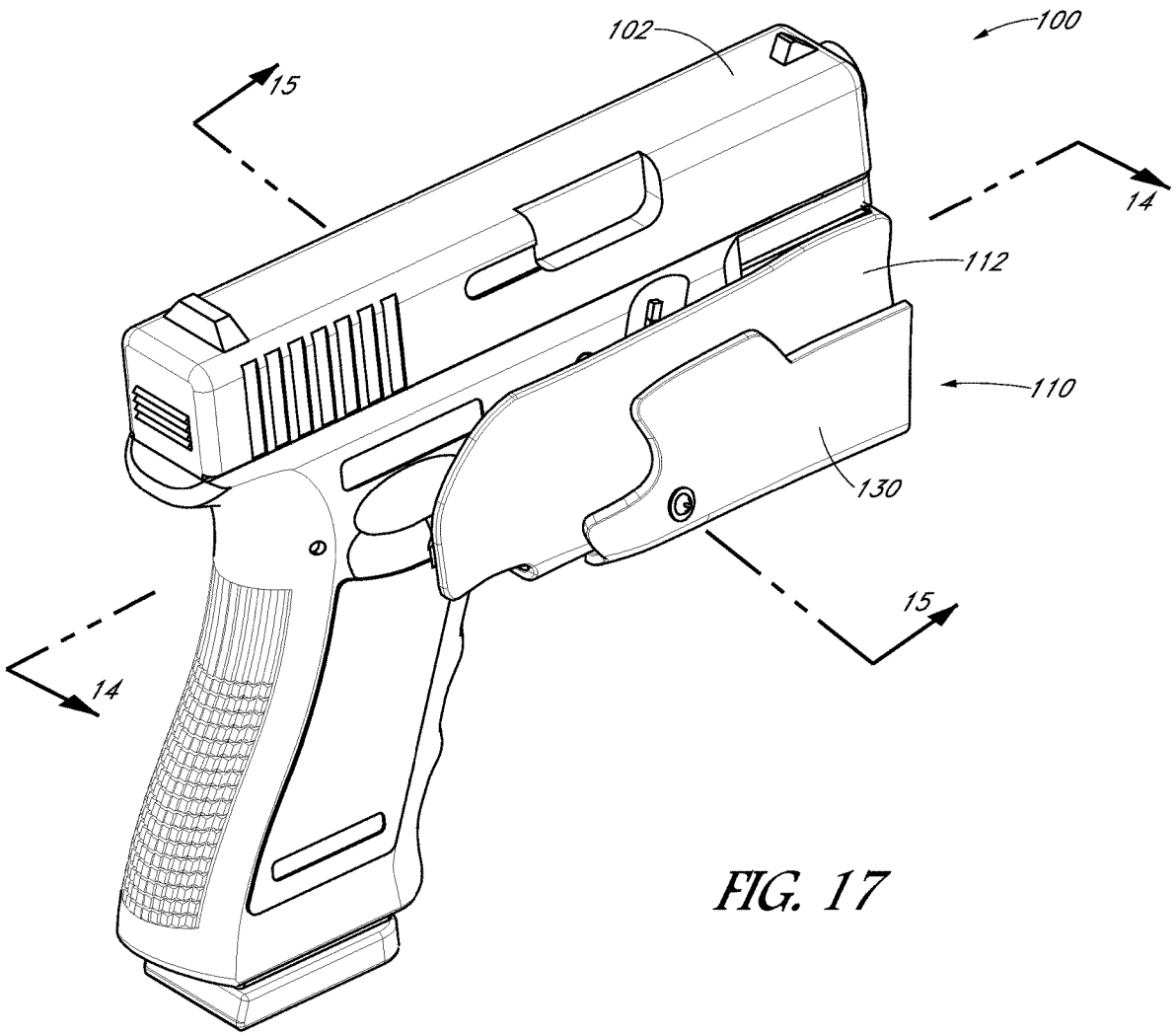
FIG. 17 illustrates a rear, top, and second side perspective view of the safety device of FIG. 1 positioned on a handgun.

FIG. 15 illustrates a rear cross-sectional view of the safety device 110 positioned on the gun 102 in an engaged position, taken along line 15-15 of FIG. 17. In certain embodiments, in the engaged position, the biasing member 158 of the ejecting unit 150 biases the ejecting member 160 to contact a front side of the trigger guard 106. As shown in FIG. 15, in the engaged position, the locking pin 140 extends laterally through the trigger guard and is at least partially secured within the mating hole 116 of the cover 112. In this position, a portion of the locking pin 140 can contact an interior front and/or bottom surface of the trigger guard 106. Such configurations can secure at least a portion of the trigger guard 106 (e.g., the front wall) between the ejecting member 160 and the locking pin 140. The trigger guard 106 can be frictionally secured between the ejecting member 160 and the locking pin 140 and/or press-fit between the ejecting member 160 and the locking pin 140. When engaged, the locking pin 140 desirably prevents the safety device from being removed from the handgun 102. This can also prevent access to the trigger 104 and/or help to inhibit or limit accidental actuation of the trigger 104.

Figure 16:
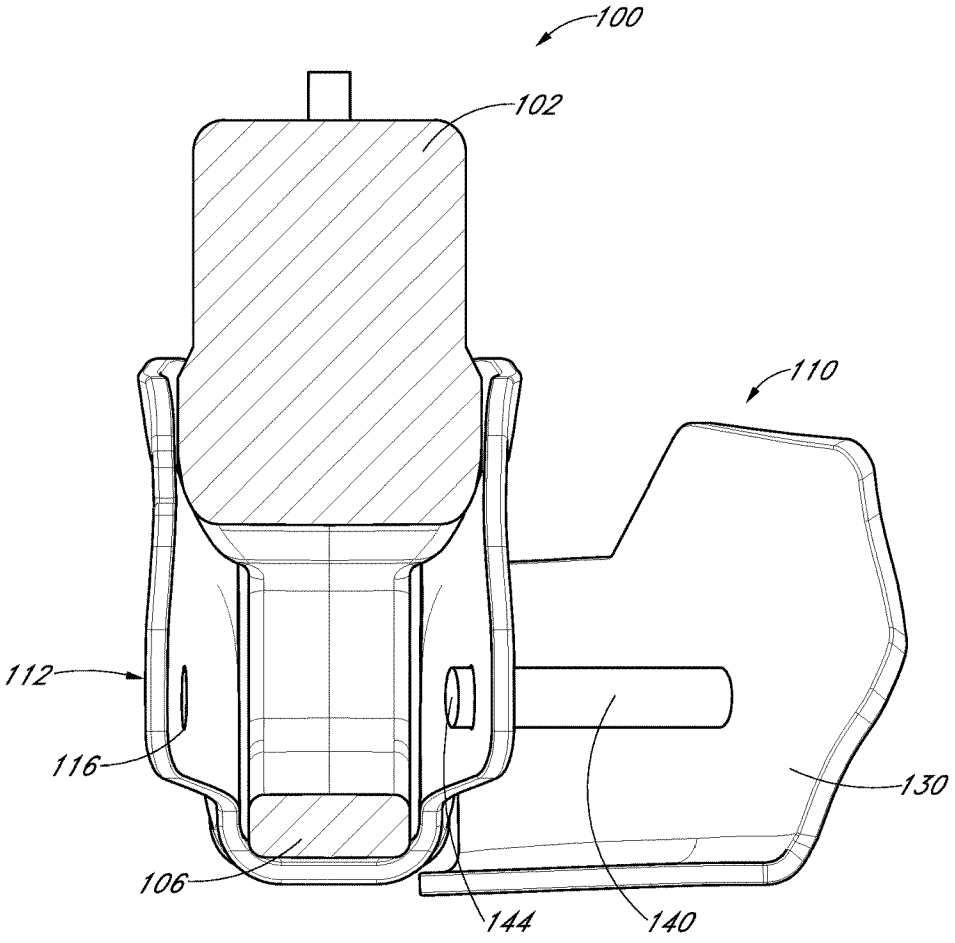
FIG. 16 illustrates a rear cross-sectional view of the safety device of FIG. 1 positioned on a handgun in a disengaged position.
Figure 18:
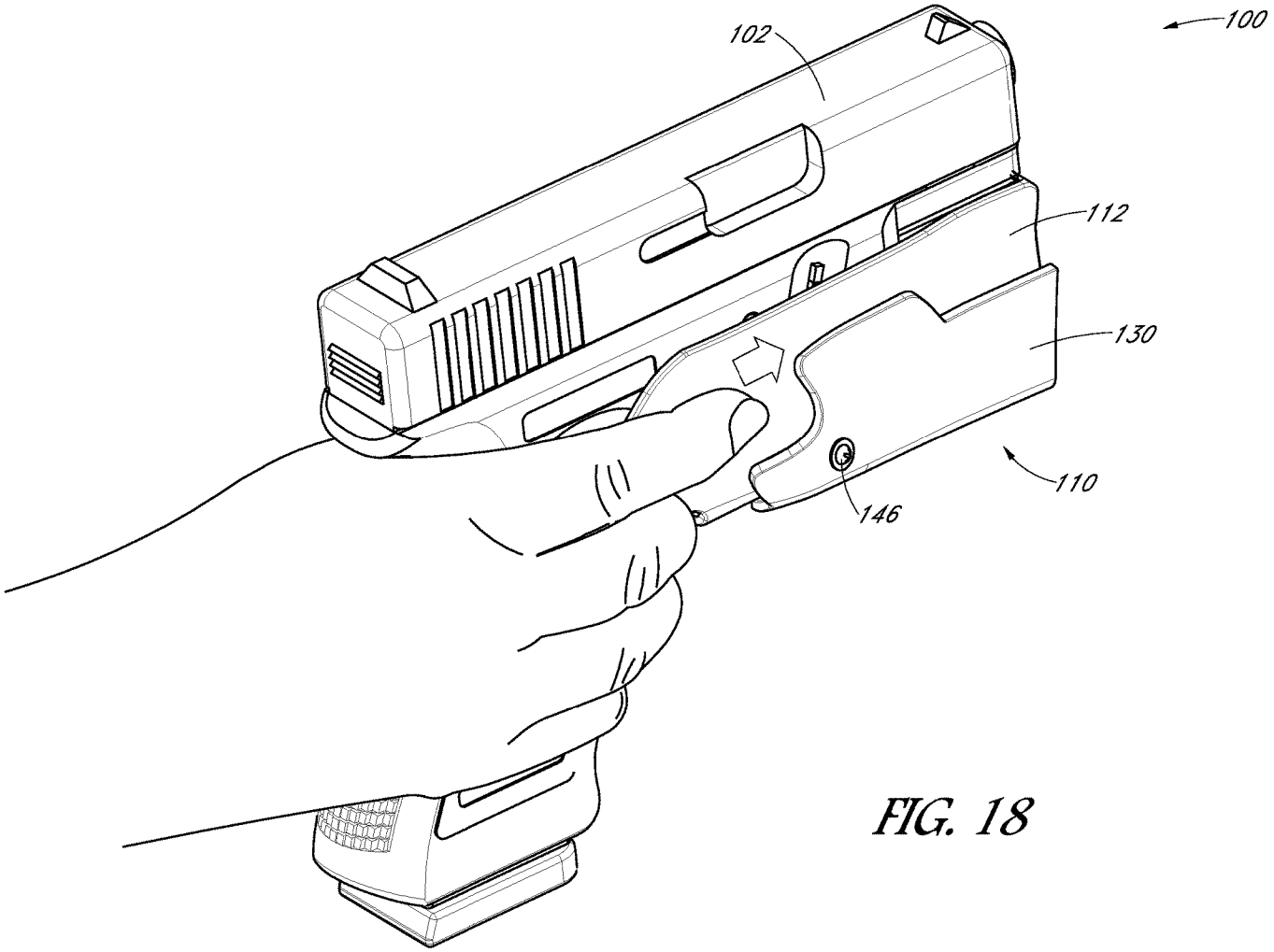
FIG. 18 illustrates a step of an example method of disengaging the safety device of FIG. 1 from a handgun, showing the safety device in an engaged position.
Figure 19:
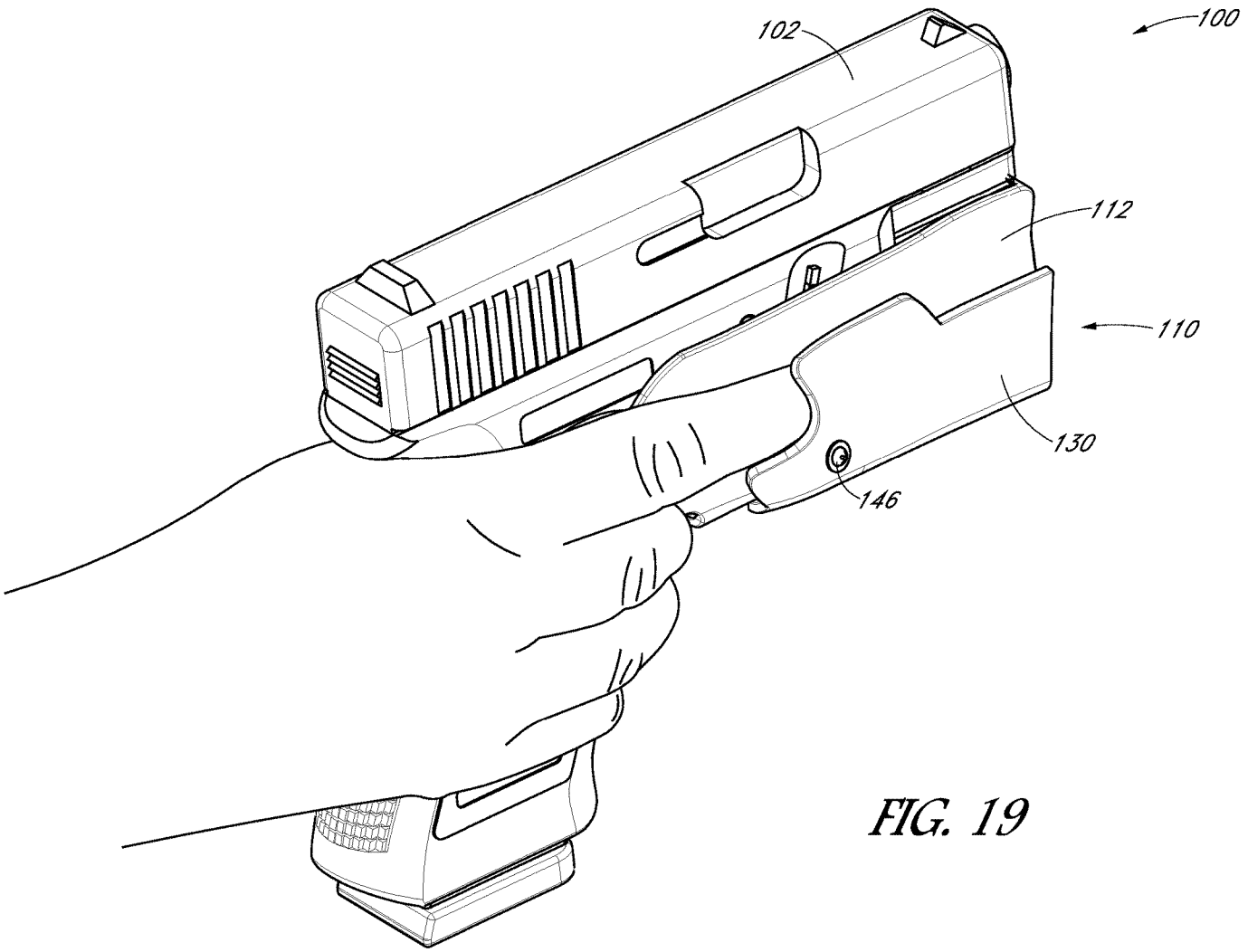
FIG. 19 illustrates a step of an example method of disengaging the safety device of FIG. 1 from a handgun, showing the safety device in an engaged or partially engaged position.

In certain embodiments, the safety device 110 can move from the engaged position (see FIG. 15) to the disengaged position (see FIG. 16). As shown in FIGS. 18 and 19, the releasing plate 130 is activated by a user's finger sliding between the releasing plate 130 and the cover 112. The releasing plate 130 can selectively disengage the locking pin 140 from the trigger guard 106 by movement of the user's finger. In certain embodiments, the user's finger further separates the releasing plate 130 from the cover 112 to disengage the locking pin 140 from the trigger guard 106.

Figure 20:
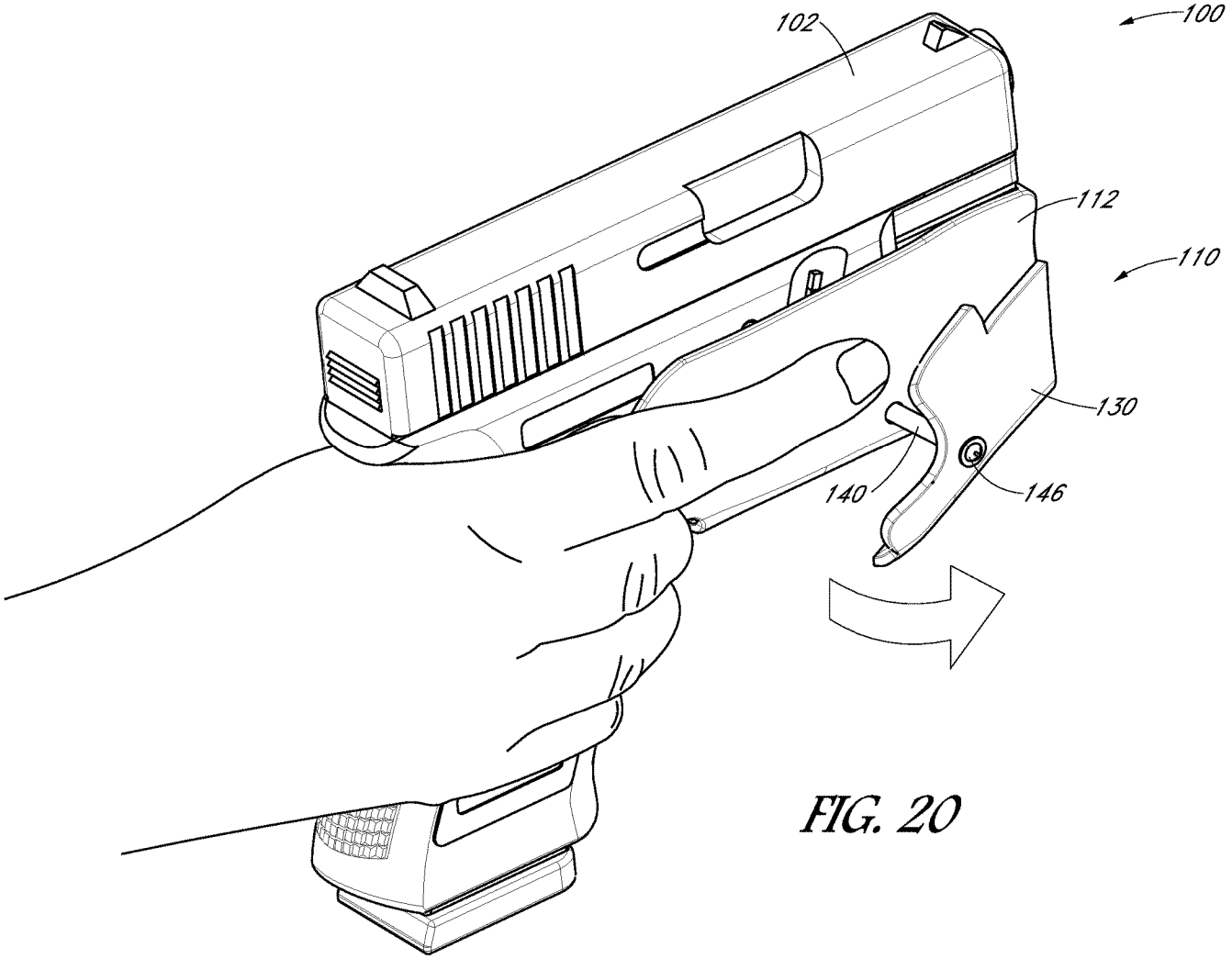
FIG. 20 illustrates a step of an example method of disengaging the safety device of FIG. 1 from a handgun, showing the safety device in a disengaged or partially disengaged position.

In certain embodiments, sliding the user's finger between the releasing plate 130 and the cover 112 can create a sufficient amount of force to at least partially or fully disengage the safety device 110 from the gun 102. Such embodiments can desirably allow the user to disengage the safety device 100 from the gun 102 quickly and easily, for example, as the user removes the gun 102 from a pocket, bag, holster, or other compartment. In certain embodiments, sliding the user's finger between the releasing plate 130 and the cover 112 may not create a sufficient amount of force to fully disengage the safety device 110 from the gun 102. As shown in FIG. 20, the user's finger may also push outwardly on an interior surface of the releasing plate 130 in certain embodiments to at least partially or fully disengage the safety device 110 from the gun 102.

In certain embodiments, as the releasing plate 130 rotates away from the cover 112, the locking pin 140 disengages from the mating hole 116. The locking pin 140 can slide across an interior space of the channel of the cover 112. In certain embodiments, the locking pin 140 slides along an interior surface of the trigger guard 106 when the releasing plate 130 is rotated away from the cover 112. In certain embodiments, the biasing member 158 extends rearwardly a greater distance as the locking pin 140 is pulled by the releasing plate 130, causing the ejecting member 160 to push against the trigger guard 106 with a greater amount of force. This can cause the safety device 110 to move in a forward direction relative to the trigger guard 106. In certain embodiments, the locking pin 140 can include a flexible material. The flexible material can allow the locking pin 140 to bend as the safety device 140 is pushed in a forward direction.

Figure 21:
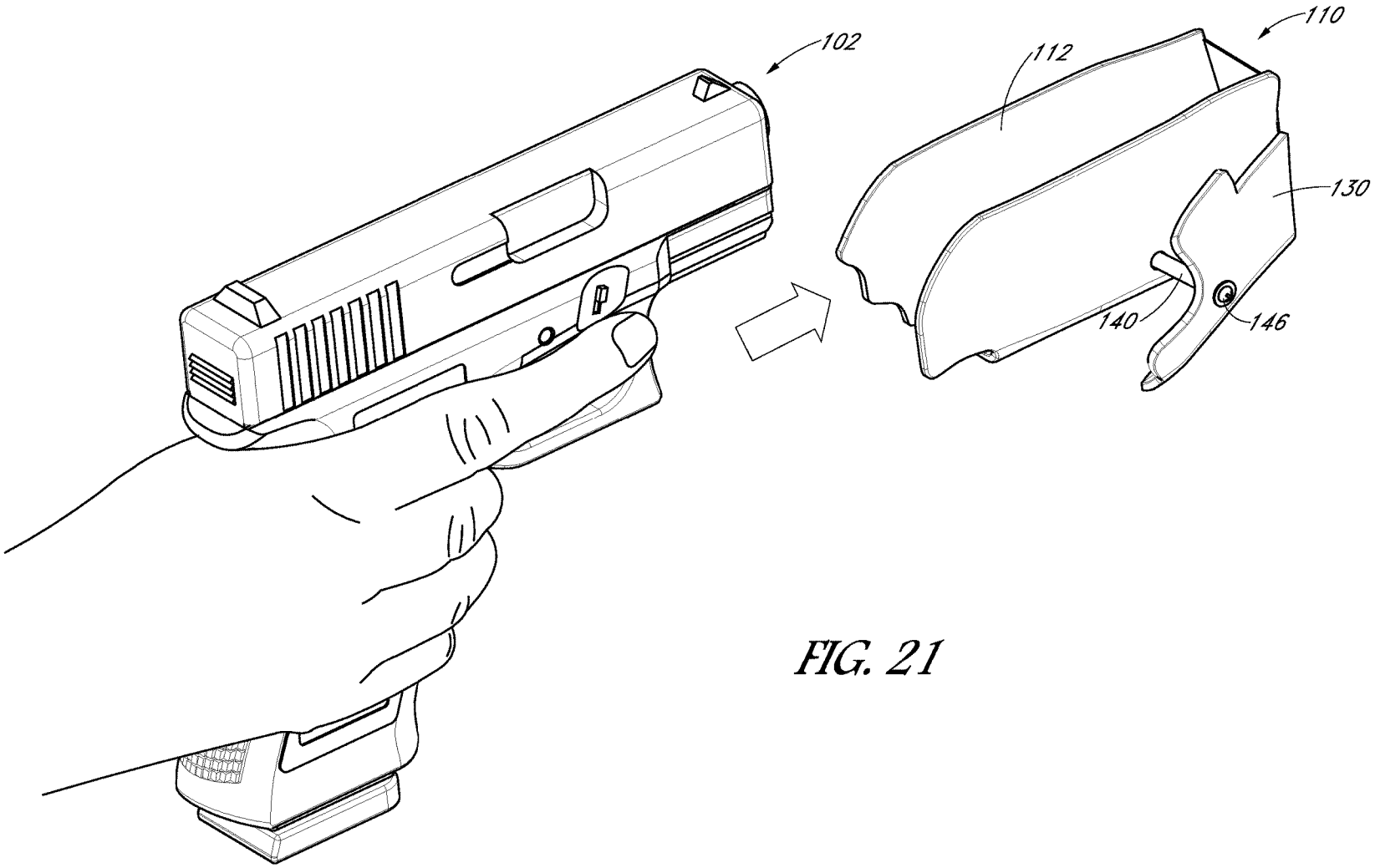
FIG. 21 illustrates a step of an example method of disengaging the safety device of FIG. 1 from a handgun, showing the safety device in a fully disengaged position.

In certain embodiments, when disengaged, the locking pin 140 allows the safety device 110 to be removed from the handgun 102. FIG. 21 illustrates an embodiment of the safety device 110 fully disengaged from the gun 102. The interior space 134 formed between the releasing plate 130 and the cover 112 may be exaggerated in certain figures, such as in FIGS. 16 and 20-21 to more clearly illustrate the safety device 110 in the disengaged position. In certain embodiments, only a slight separation of the releasing plate 130 from the cover 112 is needed to disengage the safety device 110 from the gun 102.

Certain embodiments of the safety device are designed for use by either left or right-handed individuals. As shown in the illustrated embodiments, the gun 102 can include a handgun. Certain embodiments of the safety device 110 are designed for use with other types of guns.

Various modifications to the implementations described in this disclosure can be readily apparent to those skilled in the art, and the generic principles defined herein can be applied to other implementations without departing from the spirit or scope of this disclosure. Thus, the disclosure is not intended to be limited to the implementations shown herein, but is to be accorded the widest scope consistent with the principles and the novel features disclosed herein. The word "example" is used exclusively herein to mean "serving as an example, instance, or illustration." Any implementation described herein as "example" is not necessarily to be construed as preferred or advantageous over other implementations.

Certain features that are described in this specification in the context of separate implementations also can be implemented in combination in a single implementation. Conversely, various features that are described in the context of a single implementation also can be implemented in multiple implementations separately or in any suitable sub-combination. Moreover, although features can be described above as acting in certain combinations and even initially claimed as such, one or more features from a claimed combination can in some cases be excised from the combination, and the claimed combination can be directed to a sub-combination or variation of a sub-combination.

The methods disclosed herein comprise one or more steps or actions for achieving the described method. The method steps and/or actions can be interchanged with one another without departing from the scope of the claims. In other words, unless a specific order of steps or actions is specified, the order and/or use of specific steps and/or actions can be modified without departing from the scope of any claims.

While the foregoing is directed to aspects of the present disclosure, other and further aspects of the disclosure can be devised without departing from the basic scope thereof.

What is claimed is:

1. A safety device for a trigger guard of a handgun, the device comprising:

a cover being sized and shaped to cover at least a portion of the trigger guard;

a locking member being disposed so as to move between an engaged position and a disengaged position;

a releasing member coupled to the locking member so that activation of the releasing member moves the locking member from the engaged position to the disengaged position, wherein the releasing member is configured to be activated when a user slides a finger between the cover and the releasing member and pushes outwardly on an interior surface of the releasing member; and an ejecting unit coupled to the cover and configured to contact at least a portion of the handgun, the ejecting unit being configured to bias the cover to eject the safety device from the handgun when the locking member is moved to the disengaged position.

2. The safety device of claim 1, wherein the releasing member is fixedly coupled to the locking member.

3. A safety device for a trigger guard of a handgun, comprising a cover having a locking pin, a releasing plate, and an ejecting unit, the locking pin being disposed so as to move between an engaged position and a disengaged position with the trigger guard, the releasing plate being coupled to the locking pin so that activation of the releasing plate moves the locking pin from the engaged position to the disengaged position, the releasing plate being configured to be activated when a user slides a finger between the cover and the releasing plate and pushes outwardly on an interior surface of the releasing plate, the ejecting unit being disposed in the cover and configured to contact the trigger guard, the ejecting unit being configured to bias the cover to eject the safety device from the handgun when the locking pin is disengaged with the trigger guard.

4. The safety device of claim 3 wherein the releasing plate is fixedly coupled to the locking pin.

5. The safety device of claim 3, wherein the ejecting unit is adhered to an interior surface of the cover.

6. The safety device of claim 3, wherein the ejecting unit is press-fit within an interior space defined by the cover.

7. The safety device of claim 3, wherein the ejecting unit comprises a recess configured to surround a biasing member and an ejecting member.

8. The safety device of claim 3, wherein the ejecting unit comprises a biasing member and an ejecting member positioned adjacent the biasing member.

9. The safety device of claim 8, wherein the biasing member comprises a spring.

10. The safety device of claim 8, wherein the biasing member is configured to bias the ejecting member toward the trigger guard.

11. The safety device of claim 3, wherein the cover comprises at least one side wall having a scalloped portion, the scalloped portion configured to provide access to one or more of a grip portion of the gun and a magazine lock.

12. The safety device of claim 3, wherein the cover comprises a first hinge portion and the releasing plate comprises a second hinge portion, the first and second hinge portions forming a hinge, the hinge defining an axis about which the releasing plate is configured to rotate away from the cover.

13. The safety device of claim 3, wherein the ejecting unit is configured to contact the trigger guard at at least two locations.

14. The safety device of claim 3, wherein the cover comprises a mating hole and an insertion hole.

15. The safety device of claim 14, wherein the locking pin is configured to engage at least a portion of the mating hole and the insertion hole when the safety device is in the engaged position.

16. The safety device of claim 3, wherein the cover comprises a bottom wall having a width and the trigger guard has a width, the width of the bottom wall being approximately equal to the width of the trigger guard.

* * * * *